United States Patent [19]

Le Page et al.

[11] 4,058,450

[45] Nov. 15, 1977

[54] PROCESS FOR PRODUCING AROMATIC HYDROCARBONS OF HIGH PURITY

[75] Inventors: Jean-Francois Le Page; Bernard Juguin, both of Rueil Malmaison; Jean Miquel, Paris, all of France

[73] Assignee: Institut Francais du Petrole, Rueil-Malmaison, France

[21] Appl. No.: 669,335

[22] Filed: Mar. 22, 1976

[30] Foreign Application Priority Data

Mar. 24, 1975 France ..... 75.09391

[51] Int. Cl.$^2$ ..... C10G 35/04; C07C 3/58

[52] U.S. Cl. ..... 208/66; 208/139; 260/672 R

[58] Field of Search ..... 260/672 R; 208/66, 139

[56] References Cited

U.S. PATENT DOCUMENTS

| | | | |
|---|---|---|---|
| 2,422,673 | 6/1947 | Haensel et al. | 260/672 R |
| 3,505,209 | 4/1970 | Brewer et al. | 260/672 R |
| 3,625,879 | 12/1971 | Horne et al. | 260/672 R |
| 3,901,827 | 8/1975 | Sinfelt et al. | 208/139 |
| 3,957,686 | 5/1976 | Duhaut et al. | 208/139 |
| 3,959,121 | 5/1976 | Antos | 208/139 |
| 3,969,221 | 7/1976 | Mitchell et al. | 208/139 |

*Primary Examiner*—C. Davis

*Attorney, Agent, or Firm*—Millen & White

[57] ABSTRACT

Process for producing aromatic hydrocarbons from gasolines substantially free of mono- and diolefins, comprising an aromizing step in the presence of a catalyst at a temperature from 400° to 600° C under a pressure from 1 to 30 kg/cm$^2$ followed with the separation of an aromatic cut and of an alkylaromatic cut and a step of hydrodealkylating said alkylaromatic cut by means of hydrogen recovered from the aromizing step, in the presence of a catalyst, at a temperature from 400° to 650° C, under a pressure substantially equal or lower than that of the aromizing step.

10 Claims, 2 Drawing Figures

PROCESS FOR PRODUCING AROMATIC HYDROCARBONS OF HIGH PURITY

Figure 1:
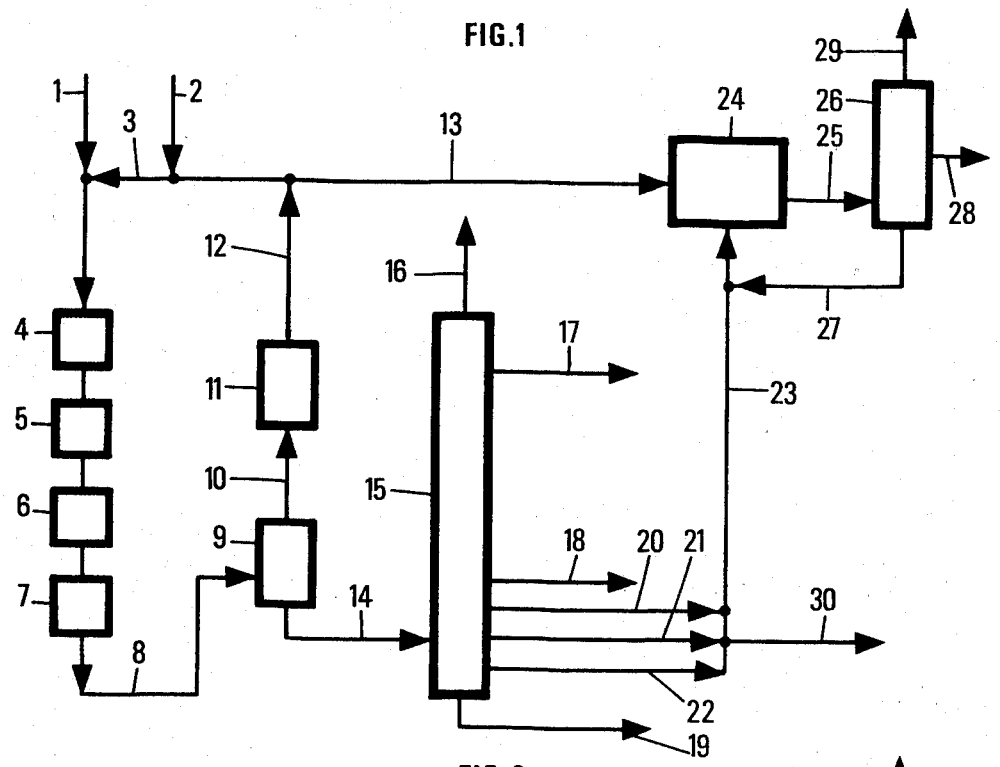

This invention concerns a process for producing aromatic hydrocarbons of high purity from straight-run or steam-cracking gasolines; more particularly, it relates to the manufacture of benzene, toluene and xylene.

The demand for aromatic hydrocarbons on the market increases regularly and it is more and more desirable to increase the capacity and reduce the cost of production thereof.

Presently, the two essential sources for the production of aromatic hydrocarbons are coal and petroleum. But the share of coal tar in this production decreases whereas, on the contrary, the share of petroleum increases.

This latter production of aromatic hydrocarbons from petroleum is conducted according to two essential methods:

1 - the steam-cracking of naphthas and heavy distillates: the aromatics which are present in the produced gasoline constitute a substantial co-product of the process.

2. - The catalytic "aromatization" of straight-run naphthas.

The objective of the second way of processing is to obtain the maximum amount of aromatic hydrocarbons from the treated raw material. The catalytic reforming process followed by an extraction of the aromatics attains to this objective. The so-called "aromizing" process described, for example, in the French pat. of addition No. 2 170 899 and the German published specification No. 2 414 282 is still more efficient for this purpose, i.e. provides, through more severe operating conditions, for a higher production of aromatic hydrocarbons, and the conversion of residual heavy paraffins to light hydrocarbons which can be separated by distillation.

The reforming and aromizing processes are accordingly adapted to produce substantially pure aromatic hydrocarbons. Generally the operating conditions are as follows:

In the case where the aromatic hydrocarbons are produced from unsaturated or saturated gasolines, the process can be conducted, as a rule, according to the conditions given hereinunder, all these conditions being however not limitative.

First of all, when treating an unsaturated charge, i.e. a charge containing diolefins and monoolefins, diolefins and alkenylaromatics, are first eliminated, for example by selective hydrogenation to monoolefins and alkylaromatics respectively, optionally followed with a convenient treatment of the effluent and a hydrogenation-hydrodesulfurization whereby monoolefins are converted to paraffins and the charge is desulfurized.

The charge, optionally freed of substantially all its diolefins and monoolefins, wherever present therein, is subjected to a hydrogen treatment in at least one reaction zone in the presence of a suitable catalyst which may contain a metal from group VIII and/or also a metal or a compound of metal from groups VI B and VII B of the periodic classification of elements (for example platinum, nickel, cobalt, palladium, iridium, ruthenium, rhenium, tungsten and molybdenum, either sulfurized or not) or another metal, at a temperature from about 400° to 600° C, under a pressure from 1 to 60 kg/cm$^2$, the hourly flow rate by volume of the liquid charge being from about 0.1 to 10 times the catalyst volume, the molar ratio hydrogen/hydrocarbons being from about 0.5 to 20. The hydrogen treatment may be conducted in one or more reaction zones.

The catalyst is generally a bifunctional catalyst, i.e. a catalyst having an acid function (due to the carrier) and dehydrogenating function; the acid function is attributable to acid compounds such as aluminas and chlorinated and/or fluorinated aluminas or other similar compounds such as alumina-silica, magnesia-silica, thoria-silica, alumina-magnesia, etc... The dehydrogenating function is attributable to the above-mentioned metals from group VIII, VI B or VII B of the periodic classification of elements.

In the case where aromatic hydrocarbons are produced from a charge consisting of naphthenic and/or paraffinic hydrocarbons, it must be recalled that said charge may be treated under well-known conventional conditions; it may also be treated substantially according to the same method as that mentioned above with the optional use, for example, of the same type of catalyst. The hydrogen treatment may be conducted in one or more reaction zones.

It has now been discovered that the hydrogenation treatment of the charge, in order to obtain well-defined aromatic products like benzene, naphthalene, etc . . . of very high purity, is advantageously carried out by simultaneously conducting, under well determined conditions, an aromizing step in at least two reaction zones, and a hydrodealkylation step in at least one reaction zone.

The simultaneous performance of these two reactions, i.e. aromizing and hydrodealkylation, results in the production of aromatic hydrocarbons (and particularly benzene) of a very high purity without resort to any additional hydrogen from an external source.

As a matter of fact, the aromizing process produces hydrogen in an amount and with a purity (higher than 70% by volume) which are quite sufficient for:

1. - self feeding the aromizing step with hydrogen,

2. - and fulfilling the hydrodealkylation requirements.

The purity of the produced hydrogen results in the saving of the very expensive "cold boxes".

It is known that an object of the reforming of hydrocarbons, which is extensively used in the petroleum industry, is to increase the values of petroleum cuts such as $C_5 - C_6$, $C_7 - 200°$ C, gasolines from catalytic cracking, thermal cracking, polymerizatin, alkylation, etc . . . by enhancing in particular their antiknock properties.

The petroleum cuts which are generally used in the catalytic reforming processes consist of normal paraffins, isoparaffins, naphthenic hydrocarbons and also, in some cases, aromatic hydrocarbons.

The catalytic reforming processes make use of catalysts having a double function and which generally contain one or more metals deposited on an acid carrier. This association of the metal with the carrier imparts to the catalyst a hydrogenating-dehydrogenating function attributable to the one or more metals, and an acid function attributable to the carrier.

In contact with the petroleum charges under convenient operating conditions, these catalysts produce a series of reactions which will be listed below in the order of decreasing velocity:

- dehydrogenation of naphthenes,
- isomerization paraffins, naphthenes and alkylaromatics,
- hydrocracking of paraffins, naphthenes and hydrodealkylation of alkylaromtics,

- dehydrocyclization of paraffins to aromatics.

Depending on the operating conditions, in the most general sense, and more particularly depending on the relative importance of the two functions of the catalyst and on the type of charge, it is possible to favor a particular elemental reaction.

Generally, the purpose of the reforming processes is to obtain a product having a higher content of aromatic hydrocarbons and isoparaffins than the starting material, since these types of hydrocarbons are those which have the higher octane numbers.

Thus, the products obtained by reforming always contain, in addition to aromatic hydrocarbons, paraffins which are generally very highly isomerized. In the case where it is desired to obtain essentially very pure aromatic hydrocarbons, such as benzene, naphthalene, etc . . . these effluents must be subjected to very selective operations of distillation and extraction in order to separate the paraffins and to obtain a charge of high aromatic content, before subjecting it to a hydrodealkylation step.

It is an object of this invention to avoid most of the intermediate steps of distillation and extraction which are very costly and time consuming by using a more efficient procedure; this system also provides, as a result of a better selectivity in the conversion of the constituents of the hydrocarbon charges, for an improved yield of LPG while obtaining very pure aromatic hydrocarbons.

The process of the invention results in the production of hydrogen during the aromizing reaction, said hydrogen being present in the recycled gases and in the purge gases; this hydrogen, after a mere cooling to −15 to +15° C, appears to be of sufficiently high purity (higher than 70% or even 75% by volume) to allow its recycling to the aromizing reactor without requiring any further purification by the conventional means of a cold box, thereby saving the investment in expensive cold boxes which furthermore require a tremendous energy consumption.

Another advantage of the process conforming with the invention is to perform the aromizing and hydroalkylation steps under similar pressures, for example of about 10 bars, which results in the saving of a compressor required in the prior art processes where the hydrodealkylation step, which follows the reforming or aromizing step, is always conducted under high pressure. The hydrodealkylation may also be performed at a lower pressure than that prevailing in the aromizing zones, in which case, of course, a compressor is also not necessary.

The present process also permits, in view of the amount and the purity of the hydrogen produced in the aromizing step, the hydrodealkylation step to be performed without additional hydrogen from an external source.

The invention relates to a method and a series of elementary steps for selectively converting hydrocarbons contained in the charge to be converted, to very pure hydrocarbons such as benzene and toluene, etc . . . and simultaneously obtaining an increased yield of LPG.

According to the present invention, one or more methods are used which permit to control the chemical reactions as well by the selection of the catalysts as by their mode of use and by adjusting the operating conditions so as to obtain a selectivity adapted to the different types of hydrocarbons present in the treated charges.

By this process it is possible:

1. - To obtain a sufficiently pure hydrogen which does not require the use of a purification system and which is obtained in a sufficient amount to avoid the need of additional hydrogen from an external source, while supplying the necessary hydrogen amount to perform the hydrodealkylation step. Accordingly, the present process just needs a small amount of fresh hydrogen to start the aromizing reaction, particularly in the first reactor.

2. - To save one compressor previously used between the aromizing and hydrodealkylation steps.

It is possible by the present process, to proceed to selective transformations of various hydrocarbons: aromatics, iso-and normal paraffins, naphthenes, contained in the charge to be treated, in the course of a series of conversion steps in the presence of hydrogen, each step being conducted under the best operating conditions in order to optimize the selectivity of the process and thereby to obtain a maximum yield of aromatic hydrocarbons of high purity and to convert all the normal paraffins and isoparaffins yet unconverted to LPG which can be subsequently separated by mere distillation.

The present invention consists of arrangements and succession of catalytic reactions conducted sequentially so as to very selectively control the reactions of dehydrogenation, hydrogenation, dehydrocyclization, hydrodealkylation and hydrocracking in view of optimizing the production of aromatic hydrocarbons of high purity and the yield of LPG.

In the aromizing reactors, arranged in series, the operating conditions must be as follows:

- the temperatures will be from 400° to 600° C and preferably from 450° to 580° C, the temperature of at least the last aromizing reactor in the direction of flow of the charge being from 480° to 600° C, preferably from 500° to 585° C and more preferably from 540° to 580° C, more specifically from 550° to 575° C. The pressures will be selected from 1 to 30 kg/cm$^2$, preferably from 5 to 20 kg/cm$^2$.The hourly flow rate by volume of the liquid charge is from about 0.1 to 10 times the volume of catalyst; the molar ratio hydrogen/hydrocarbons is from about 0.5 to 20. Preferably, the temperature of the last aromizing zone wherethrough the charge is passed is higher than that prevailing in one or more of the other aromizing zones.

The reaction is conducted in the presence of a catalyst which must contain (a) a carrier with an alumina base, (b) 0.1 to 10% by weight of at least one halogen with respect to the catalyst carrier and (c) at least two metals or metal compounds, at least one of which is selected from the noble metals from the platinum family, (platinum, palladium, rhodium, ruthenium, osmium and iridium), the concentration of said metal being from 0.01 to 5% by weight with respect to the catalyst carrier, the other metal being either a nobel metal from the platinum family or any other metal as stated below.

Two preferred schematic flowsheets illustrating two optional modes of carrying out the process are shown in the accompanying drawings.

The first flowsheet (FIG. 1) relates to the case of straight-run cuts ($C_5$ – 200° C) i.e. charges containing paraffinic, naphthenic, etc. . . hydrocarbons or containing cuts produced by catalytic reforming.

In this case, there is performed in at least two reaction zones, an aromizing step followed by a hydrodealkylation step. A mere distillation will subsequently produce, for example, benzene of a high purity degree.

The second flowsheet (FIG. 2) concerns the case of pyrolysis gasolines or steam-cracking gasolines.

In this latter case, the charge must be first subjected to a selective hydrogenation in one or two steps in order to remove the diolefins and the alkenyl aromatic compounds, and thereafter, the resulting product will be subjected in at least two reaction zones, to an aromizing step, followed by hydrodealkylation and, as in the first diagram, a mere distillation will produce, for example, benzene of a very high purity degree.

First case (FIG. 1)

AROMIZING STEP

The charge to be treated (cut $C_5$ – 200° C), previously desulfurized and made free from nitrogen by any known means, is introduced through duct 1, in the presence of hydrogen which is introduced through ducts 2 and 3, into four successive reaction zones 4, 5, 6 and 7 containing a suitable catalyst adapted to convert the naphthenic hydrocarbons to aromatics, the paraffinic hydrocarbons preferably to aromatics and the remainder to LPG.

It must be noted that in the case of several reaction zones, as in the present case of FIG. 1, it may be advantageous to make use of different catalysts in each of the different reaction zones.

Moreover, in the case of several reaction zones, it may also be sometimes advantageous, in order to improve the treatment with hydrogen, to divide the process into two or more steps, each step being performed in a different reactor, in order to adapt to each step the operating conditions: pressure, temperature, VVH and $H_2$/HC.

There can be used:

a. - either at least two fixed bed reactors, with the optional provision of an additional reactor which will be in operation during the regeneration of the catalyst in one of the fixed bed reactors;

b. - or at least two fluid bed reactors;

c - or combinations of fixed bed and fluid bed reactors;

d. - or, and this is often one of the best solutions when it is desired to proceed continuously over long periods, at least one moving bed reactor, the other reactors being, for example, fixed bed reactors or also moving bed reactors; the method (described in the French Pat. No. 2 160 269), consists of passing the charge and hydrogen through at least one reaction zone containing a catalyst, for example a granular catalyst, the catalyst being progressively introduced from one end of the reaction zone and progressively withdrawn from the other end of the reaction zone, then conveying the catalyst progressively withdrawn from the reaction zone to a regeneration zone, the catalyst once regenerated and reduced in the presence of a hydrogen stream being progressively reintroduced at the end of the reaction zone opposite to that from which the catalyst has been withdrawn, for replacing the catalyst withdrawn from the reaction zone, in order to maintain a high level of activity substantially constant at each point of the reaction zone.

The withdrawal of the catalyst from each moving bed reactor or from the moving bed reactors where several reactors are used, is performed progressively as above-mentioned. By the term "progressively" is meant that the catalyst may be withdrawn:

- either periodically, for example at a rate from 1/10 to 10 days, by withdrawing at each time only a fraction, for example 0.5 to 15%, of the total catalyst amount.

However it is also possible to withdraw this catalyst at a much more rapid rate (of the order of one minute or one second, for example), the withdrawn amount being accordingly reduced, or in a continuous manner.

The one or more moving bed reactors as well as the regeneration zone may be arranged at will, e.g. side by side. It may thus be necessary to periodically convey the catalyst from a relatively low point to a relatively high point, e.g. from the bottom of a reaction zone to the top of the regeneration zone; this conveyance is performed by means of any known lifting device, for example by means of a fluid. The fluid of the lift used for conveying the catalyst may be any convenient gas, for example nitrogen or hydrogen, and more particularly purified hydrogen.

The solid which is thus displaced through the one or more moving bed reactors may be a granular catalyst including a suitable carrier: this catalyst may have, for example, the shape of spherical balls of a diameter generally from 1 to 3 mm, preferably from 1.5 to 2 mm, although these values are not limitative. The bulk density of the catalyst may be, for example, from 0.4 to 1, preferably from 0.5 to 0.9 and more particularly from 0.6 to 0.8, these values being not limitative.

As catalysts, we will use advantageously one of those described in the French pat. Nos. 2 134 763, 2 174 727, 2 087 391 and 2 080 014 and the German published patent application 2, 414 282.

Generally, these catalysts contain, in addition to a carrier, at least two metals or metal compounds. For example, the catalyst contains at least one noble metal from group VIII, e.g. platinum, to which there can be added at least one moderating or stabilizing element, which may be selected from the metals of group VIII such as palladium, rhodium, osmium, iridium, ruthenium, cobalt, etc . . . and from such metals as, for example, copper, gold, silver, etc . . . Moreover, these catalysts may contain an element capable to coordinate the effect of the assembly of "deposited metals-carrier", for example, manganese, rhenium, tungsten, molybdenum, etc . . .

The preferred catalysts i.e. those which appeared as the most efficient in this combined aromizing-hydrodealkylation process are those which contain:

a. - alumina, b. - 0.1 to 10% of at least one halogen expressed by weight with respect to the catalyst carrier, c. - 0.005 to 2% of platinum expressed by weight with respect to the catalyst carrier, d. - 0.02 to 0.1% by weight with respect to the catalyst carrier of a metal selected from iridium and rhodium, e. - 0.02 to 0.1% by weight with respect to the catalyst carrier, of a metal selected from copper, silver, gold and manganese, and f. - optionally 0.1 to 0.4% of cobalt expressed by weight with respect to the catalyst carrier.

The catalyst may be prepared according to conventional methods consisting of impregnating the carrier by means of solutions of compounds of the metals to be introduced. There is used either a common solution of these metals or a separate solution for each metal. When using several solutions, it may be convenient to proceed to intermediate drying and/or roasting step. The final step is usually a calcination, for example at a temperature from about 500° to 1000° C, preferably in the presence of free oxygen, for example, by scavenging with air.

As examples of compounds of cobalt, rhenium, tungsten, molybdenum, copper, gold, silver, cadmium, manganese or of any other useful metal (lead, tin, germanium, lanthanum, lanthanide, scandium, titanium, zirconium, niobium, etc . . . ), we can mention, for example, the nitrates, chlorides, bromides, fluorides, sulfates or acetates of these metals or any other salt of these metals which is soluble in water or hydrochloric acid (e.g. a chloroplatinate).

Platinum may be used in any of its known forms, for example, hexachloroplatinic acid, ammonium chloroplatinate, platinum sulfide, sulfate or chloride. Iridium, ruthenium, palladium, osmium and rhodium may be used in any known form, for example as chlorides, bromides, sulfates or sulfides or still in the form of hexachloroiridic, hexabromoiridic, hexafluoridic or hexachlororuthenic acid, or in the form of other ruthenium, palladium, osmium and rhodium compounds.

Halogen may be supplied by one of the above-mentioned halides or may be introduced in the form of hydrochloric acid or hydrofluoric acid, ammonium chloride, ammonium fluoride, gaseous chlorine or hydrocarbon halides, for example $CCL_4$, $CH\ CL_3$ or $CH_3CL$.

The carrier is generally an alumina of appropriate surface and pore volume (e.g. 200 to 400 $m^2/g$ for the specific surface and 0.4 to 0.7 cc/g for the pore volume).

The surface acidity of the carrier is generally such that the neutralization heat by adsorption of ammonia at 320° C under a pressure of 300 torr is higher than 20 calories per gram (the method for measuring said heat is indicated hereunder). The preparation and method of use of the catalyst has already been described in the above-mentioned French Patents.

The regeneration of the catalyst may be performed by any known method or according to the method described, for example, in the French Pat. No. 2,160,269.

It will be noted that, in the case of several reaction zones, it may be advantageous to make use of different catalysts in each of the different reaction zones. Moreover, in the case of two or more reaction zones, it may also be advantageous, in order to improve the treatment with hydrogen, to divide the treatment performed in one of the reaction zones into two steps $\alpha$ and $\beta$, each of these steps being conducted in a different reaction zone:

- step $\alpha$ may be conducted at a temperature from about 400° to 600° C and under a preferred pressure of 1 to 60 $kg/cm^2$, in the presence of hydrogen and catalyst,
- step $\beta$ may be conducted at a temperature from about 500° to 600° C, under a preferred pressure of 1 to 60 $kg/cm^2$, in the presence of hydrogen and a catalyst.

The catalyst used in step $\alpha$ may be substantially neutral and of a specific surface lower than 100 $m^2/g$ (the carrier is, for example, gamma alumina) and the catalyst used in step ($\beta$) is acid and has a relatively high specific surface (there is used, for example, cubic gamma alumina or chlorinated and/or fluorinated aluminas). In these catalysts, the metal elements may be identical or different in each of the steps ($\alpha$) and ($\beta$) and are those disclosed in the above-mentioned patents.

SEPARATION-FRACTIONATION STEP

After treatment of the charge, as above-stated, the resulting product, withdrawn from reactor 7 through duct 8, is liberated by any convenient means (e.g. by stripping) of normally gaseous product. The products are then subjected to one or more fractionations in order to obtain various cuts containing ethylbenzene, xylenes and $C_9$+ hydrocarbons and a $C_6$ and/or $C_7$ cut containing benzene (benzene fraction) and/or toluene (toluene fraction), as desired. In addition, up to now, it was often necessary to resort to such treatments as extractions or extractive distillations, but these treatments are no longer required when the reaction producing aromatics has been performed in accordance with the present invention.

The product discharged from the last reactor 7 has an increased aromatic content (by dehydrogenation of naphthenes, isomerization and dehydrogenation of alkylnaphthenes and dehydrocyclization of paraffins). In addition, it almost entirely consists of aromatic compounds, since the content of non aromatic compounds is decreased to less than 6%, as compared to about 20% in the processes according to the prior art (charges for extraction or for hydrocracking — at high temperature — hydrodealkylation). Moreover, the composition of the non aromatic hydrocarbons has been changed, the paraffins discharged from the reactor being, as an average, lighter and accordingly, more easy to separate.

Thus, the product withdrawn from the last aromizing reactor will be conveyed through duct 8 to a separator 9 where the gaseous products consisting almost entirely of hydrogen; methane and ethane are removed through duct 10.

In the conventional aromatization processes, where at this stage, hydrogen is not sufficiently pure for being recycled to the reactors, it is necessary to remove, by condensation, the very light hydrocarbons present in the gases discharged from a flash unit such as 9. It is thus necessary in the conventional processes, to make use of a "cold box" operated at a very low temperature of about −160 to −200° C. On the contrary, in the present process, the hydrogen of the gaseous mixture withdrawn from line 10 is sufficiently pure to obtain hydrogen of purity higher than 70% or even 75% by volume, by merely passing the gaseous stream from duct 10 through a cooler 11 whose temperature, instead of being close to −180° C, according to the prior art, is only in the range from −15 to +15° C, preferably from −10 to +10° C and more particularly, from −4 to +8° C. There is thus recovered through duct 12 a hydrogen stream sufficiently pure for being recycled, on the one hand, to the aromizing reactors 4, 5, 6 and 7 through duct 3 and, on the other hand, to the hydrodealkylation reactor 24, through duct 13. It shall be noted here that the hydrogen amount supplied from duct 12 is largely sufficient, on the one hand, to ensure the continuation of the aromizing reaction (this reaction producing hydrogen) in reactors 4, 5, 6 and 7, except of course when starting the aromizing reactions where it is necessary to introduce fresh hydrogen or recycled hydrogen produced in an other refining or petrochemical unit (through duct 2) in order to initiate the reactions, and, on the other hand, for performing the hydroalkylation in reactor 24.

After the separation at 9 of the hydrocarbons having less than 5 carbon atoms, the product issued from the aromizing step, is conveyed through duct 14 to the fractionation device 15, which performs a conventional fractionation to obtain the desired cuts. For example, according to FIG. 1, the $C_{10}$+ hydrocarbons heavier than $C_9$ are withdrawn from the bottom of the column through pipe 19 and the hydrocarbons having less than 6 carbon atoms are withdrawn separately from the top through duct 16.

The xylene cut may be separated if so desired through duct 30 and complies with required specifications. A $C_5$–$C_7$ cut may be withdrawn from duct 17 and a first benzene fraction from duct 18.

The other aromatic hydrocarbons, particularly toluene, the $C_9$ and optionally $C_8$ hydrocarbons, may be fed at least partly or entirely directly to the catalytic hydrodealkylation unit 24, through ducts 20, 21, 22 and 23, so as to obtain benzene of very high purity.

The fractionation device 15 is operated under a pressure substantially equal to or lower than that prevailing in the aromizing zones.

HYDRODEALKYLATION STEP

The hydrodealkylation treatment may be performed in at least one reaction zone i.e. in at least one reactor; there can be used:

1. - either one or more fixed bed reactors with the optional provision of an additional reactor which will be operated during the regeneration of the catalyst in one of the fixed bed reactors,
2. - or one or more fluid bed reactors,
3. - or, and this is often one of the best solutions when it is desired to proceed continuously over long periods, at least one moving bed reactor; the method (decribed in the French Pat. No. 2 160 269 consists of passing the charge and hydrogen through at least one reaction zone containing a catalyst, for example a granular catalyst, the catalyst being progressively withdrawn from the other end of the reaction zone, then conveying the catalyst progressively withdrawn from the reaction zone to a regeneration zone, the catalyst once regenerated and reduced in a hydrogen stream, being progressively reintroduced at the end of the reaction zone opposite to that from which the catalyst has been withdrawn, in order to replace the catalyst withdrawn from the reaction zone and to maintain a high activity level which is substantially constant at each point of the reaction zone.

The discharge of the catalyst from one or more moving bed reactors is performed progressively as abovementioned. By "progressively" is meant that the catalyst may be withdrawn:

either periodically, for example at a rate of 1/10 to 10 days, by withdrawing only a fraction at each time, for example 0.5 to 15% of the total amount of the catalyst. But it is also possible to withdraw the catalyst at a higher frequency (of the order of a minute or a second for example), the withdrawn amount being accordingly reduced, or in a continuous manner.

The one or more moving bed reactors as well as the regeneration zone may be arranged at will, for example side by side.

It may thus be necessary to convey the catalyst repeatedly from a relatively low point to a relatively high point, for example from the bottom of a reaction zone to the top of the regeneration zone; this conveyance is achieved by means of any known lifting device, for example by means of a "lift". The fluid of the "lift" used for conveying the catalyst may be any convenient gas, for example nitrogen or hydrogen and more particularly, purified hydrogen or recycled hydrogen.

The solid which is displaced through the one or more moving bed reactors may be a granular catalyst, containing a suitable carrier; this catalyst may be shaped, for example, as spherical balls of a diameter from 1 to 3 mm, preferably from 1.5 to 2 mm, these values being however not limitative. The bulk density of the catalyst may be, for example, from 0.4 to 1, preferably from 0.5 to 0.9, more particularly from 0.6 to 0.8, these values being however not limitative.

The regeneration of the catalyst is performed by any known means or may be performed according to the method described, for example, in the French Pat. No. 2 160 269.

This hydrodealkylation step may be conducted at a temperature from 400° to 650° C, preferably from 500 to 620° C, under a pressure from 1 to 30 kg/cm$^2$ and preferably from 5 to 20 kg/ cm$^2$, the spatial velocity being from 1 to 10 and preferably from 2 to 8 and the ratio hydrogen to hydrocarbons expressed in mole per mole being from 1 to 10 and preferably from 3 to 8. Necessarily, the pressure in the one or more hydrocracking reactors is substantially equal to or lower than the pressure prevailing in the aromizing reactors.

The catalyst contains a carrier which generally is alumina.

The carrier is so selected as to obtain a catalyst having generally not too high a specific surface, for example about 1 to 100 m$^2$/g, preferably from 5 to 80 m$^2$/g, and still preferably from 9 to 55 m$^2$/g and a total pore volume from 0.2 to 1.0 cc/g, preferably from 0.3 to 0.8 cc/g, more particularly from 0.3 to 0.7 cc/g; the acidity of the catalyst must be preferably sufficiently low: the heat of neutralization by adsorption of gaseous ammonia at 320° C under a total pressure of $NH_3$ of 300 Torr must be preferably not higher than about 10 calories per gram and preferably, even lower than 7 calories per gram.

The acidity of the carrier (or the catalyst) is determined by the known test of ammonia adsorption of the type disclosed for example in "Journal of Catalysis 2, 211–222 (1963)": the method consists of heating the catalyst at 600° C under vacuum (i.e. at a pressure lower than about 0.01 mm of Hg) up to complete gas removal (in order particularly to remove water and undesirable impurities); then the catalyst is placed in a calorimeter at 320° C and ammonia is introduced in such an amount that the final pressure of the system at equilibrium be 300 mm Hg and the amount of heat evolved is measured. It must be noted that the neutralization heat of the alumina used as carrier of the hydrodealkylation catalyst is substantially identical to that of the catalyst itself and that also the specific surface and the pore volume of the alumina used as carrier are substantially identical to the above-mentioned values given for the catalyst itself.

The catalysts preferably contain at least two metal elements or two metal compounds.

As metals there can be used those from group VIII, which are for example selected from cobalt, nickel, ruthenium, osmium, palladium, rhodium, iridium and platinum either associated to one another or to metals from group VI B (molybdenum and tungsten) or metals from group VII B (rhenium and manganese).

In view of their activity, selectivity and stability, it may be preferable to make use of metal pairs such as platinum-iridum, platinum-ruthenium, iridium-ruthenium, rhenium-tungsten, platinum-tungsten, iridium-tungsten, ruthenium-tungsten, iridium-rhenium, ruthenium-rhenium, platinum-rhenium, molybdenum-rhenium, and platinum-molybdenum.

For example, the content by weight of each metal in the catalyst will be from 0.05 to 5% and preferably from 0.1 to 1%. The atomic ratio of the two metals of the pair may be, for example, from 0.1 to 20.

There can also be used catalysts containing at least two metals such as catalysts A and B, defined as follows:

Catalyst A contains essentially:

a. - a carrier (generally alumina), b. - at least one metal selected from the group consisting of the metals of group VIII of the periodic classification of elements, and c. - at least one additional metal selected from the group consisting of zinc, cadmium, gallium, indium, thallium, germanium, manganese, copper, silver, gold, lanthanum, scandium, neodymium, praseodymium, samarium, europium, uranium, thorium, yttrium, cerium, titanium, hafnium, niobium, zirconium and tantalum.

The metals or group VIII, are selected from cobalt and the noble metals from group VIII, i.e. ruthenium, osmium, palladium, rhodium, iridium and platinum.

In view of their stability, it may be advantageous in some cases to make use of pairs of metals of group VIII such as platinum-iridium, platinum-ruthenium or iridium-ruthenium, etc . . .

The content of noble metal of group VIII (or of each of the noble metals of group VIII if the catalyst contains several metals from this group) will be from 0.05 to 5% and preferably from 0.1 to 1%. When the catalyst contains pairs of noble metals of group VIII, the atomic ratio between the two metals of the couple, may be for example from 0.1 to 20.

For example, for a catalyst having a total metal content of 1%, the content of one of the metals may be from 0.1 to 0.9% while the content of the other metal will vary complementarily.

When using cobalt as metal from group VIII, the cobalt concentration will be from 0.05 to 20% and preferably from 1 to 17% by weight of the catalyst. The content by weight of the catalyst in so-called additional metal is generally from 0.05 to 5% and preferably from 0.1 to 2%. When the metal from group VIII is cobalt, the content of additional metal is preferably from 0.2 to 20%, preferably from 0.8 to 17% and, optionally, if the cobalt concentration is high, from 5.5 to 13%.

When the catalyst contains pairs of said additional metals, the atomic ratio between the two metals of the pair may be, for example, from 0.1 to 20.

The catalysts containing cobalt and an additional metal, said metal being preferably selected from zinc, cadmium, gallium, indium, germanium, manganese, copper, silver, gold, niobium and zirconium, are particularly efficient.

Catalyst B contains essentially:

a. - a carrier (generally alumina), b. - at least one metal selected from a first group consisting of chromium, molybdenum, tungsten, rhenium and manganese, the concentration of the one or more metals being from 0.05 to 20% by weight of the catalyst, preferably from 0.1 to 10%. When the catalyst B contains pairs of metals from the first group, the atomic ratio between the two metals of the pair may be, for example, from 0.1 to 20.

For example, as concerns a catalyst having a total metal content of 10%, the content in one of the metals of the first group will be from 0.1 to 9.9% while the content in the other metal will vary complementarily, c. - at least one additional metal, different from the metal selected from the first group, said additional metal being selected from chromium, molybdenum, tungsten, rhenium, manganese, copper, silver, gold, zinc, cadmium, gallium, indium, thallium, germanium, tin, lead, titanium and zirconium, the content in said one or more metals being from 0.05 to 20% by weight of the catalyst and preferably from 0.1 to 5%.

When the catalyst contains pairs of said so-called additional metals, the atomic ratio between the two metals of the pair may be, for example, from 0.1 to 20.

The hydroalkylation catalyst thus contains preferably at least two metals but may contain three metals or more. In the case of catalysts containing three metals, the second metal acts as moderator and the third metal as coactivator.

The method of manufacture of the catalyst is not a critical feature of the invention and any known method may be used. The active elements will be, for example, deposited separately or preferably simultaneously on the carrier by impregnation from solutions containing the same, for example, aqueous solutions of nickel nitrate, platinum, iridium, rhodium and ruthenium chlorides, hexachloroplatinic and hexachloroiridic acids, etc . . . , noble hexachlorometallates, ammonium tungstates, molybdate and perrhenate, etc . . . This list is not limitative and any other salt or organo-mettallic compound soluble in water or in organic solvents may also be used.

The metal elements once deposited on the carrier, the catalyst is then dried, roasted by heating in oxidizing, reducing or inert atmosphere, depending on the case, at a temperature, for example, from 300° to 600° C, then reduced under a hydrogen stream at a temperature, for example, from 350° to 700° C for 2 to 30 hours with a hourly flow rate of hydrogen from about 100 to 1000 times the catalyst volume. The latter operation is preferably conducted in a hydrodealkylation reactor. The calcination step may also be omitted and the reduction performed directly.

For the reduction, the use of hydrogen is not necessarily limitative; there can be used other reducing agents, for example: hydrazine, carbon monoxide, alkyl metals (of aluminium, zinc, etc . . . ); the reduction may be performed as well in a gaseous medium as in a liquid medium.

After separation in zone 26, through duct 29, of the normally gaseous constituents i.e. hydrogen, hydrocarbons up to $C_5$ and hydrogen sulfide, the resulting $C_6$+ cut is conveyed through duct 27 to the hydrodealkylation reactor 24 after heating up to the required temperature and the process is continued. The desired cut is withdrawn as final product (e.g. benzene) through duct 28. It must be noted that according to the process of the invention, it is necessary to proceed in the hydrodealkylation reaction at a pressure substantially equal to or lower than the pressure prevailing in each of the aromizing reactors, in order to avoid the expensive use of a compressor (still used in the prior art processes), which would be necessary to increase the pressure of the stream of products issued from the aromizing zones and fed to the hydrodealkylation zone generally operated under substantially high pressures.

Figure 2:
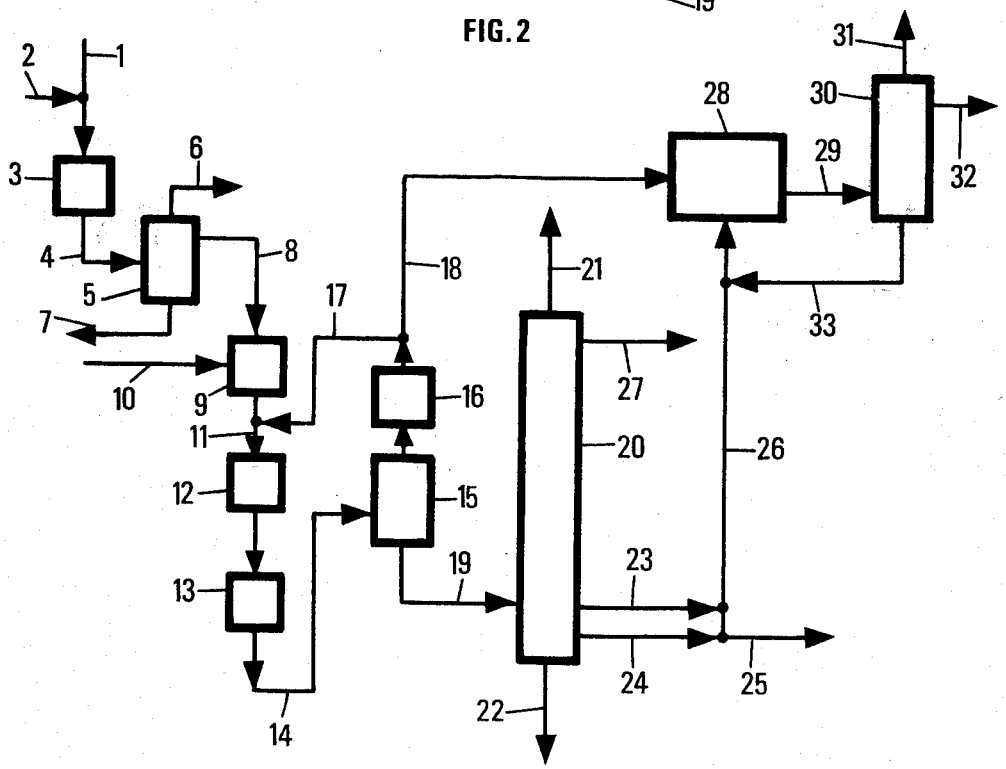

Second case (FIG. 2)

The steam-cracking or pyrolysis gasolines are first subjected to a conventional selective hydrogenation for removing diolefins and olefins.

This operation is performed in one or more reaction zones; a method consists of arranging two hydrogenation zones: in a first zone 3 the charge introduced through duct 1 is treated in liquid phase, i.e. at the outlet from the first reaction zone 3, a minimum of 50 % by weight of the initial charge is still in liquid phase, the remaining fraction, if any, having vaporized in the reaction zone. This vaporization is due to the exothermicity of the hydrogenation reaction. The necessary hydrogen is introduced through line 2. The temperature inside the reaction zone may vary from 50° to 200° C or more but it is preferable not to exceed 200° C at the outlet in order to avoid too substantial a polymerization of the unsaturated components of the charge.

The liquid charge is introduced into the reaction zone 3 at a temperature generally from about 50° to 120° C. The pressure in zone 3 must be sufficiently high in order to maintain at least the major part of the charge in the liquid state. Generally said pressure will be from 20 to 45 bars.

In said first zone 3, the liquid charge is contacted with a hydrogenation catalyst containing at least one metal from group VIII of the periodic classification of elements, the catalyst being used in fixed bed, moving bed or even in supension (for example in the case of use of Raney nickel or cobalt). The carrier will be selected from those having a small surface acidity.

These supported catalysts normaly contain from 5 to 50 % by weight of active metal.

The spatial velocity (VVH) i.e. the volume of charge introduced per liter of catalyst and per hour, may be from 0.5 to 5. The VVH depends on the activity of the catalyst and the content of unsaturated compounds of the charge.

The molar ratio hydrogen to hydrocarbons will be, for example, from 0.1 to 1.

The effluent from zone 3 is withdrawn through duct 4.

At the outlet from said reaction zone 3, we generally proceed to a first fractionation in zone 5 in order, for example, to remove the light products through duct 6 and the heavy products through duct 7.

The main fraction (generally a $C_6$–$C_8$ cut) will then be introduced through line 8 into the second reaction zone 9 at a temperature generally from 230° to 300° C. The charge and hydrogen (introduced through line 10) will then be contacted with the catalyst containing, for example, a metal from group VI A of the periodic classification of elements, either alone or in admixture with one or more metals from group VIII. These metals are deposited on a carrier whose surface is generally from 50 to 250 $m^2/g$. We prefer substantially neutral carriers, i.e. those having a low surface acidity.

In said reaction zone 9, the temperature is preferably from 230° to 360° C. It is possible, in order to avoid too high a temperature increase, due to the exothermicity of the reaction, to introduce, at least at one intermediate point of the catalyst bed, a fraction of the charge which may issued either from the first step or from recycling.

The pressure may be from 25 to 60 bars. The hydrogen amount is such that the molar ratio hydrogen to olefins is from 5 to 15 and the partial hydrogen pressure in the catalyst bed is from about 8 to 30 bars.

The spatial velocity VVH of the charge is from 4 to 20, the volume of charge being measured in the liquid step.

The catalysts will be used preferably in the sulfurized form but they may also be used as oxides.

When it is desired to maintain a good sulfurization of the catalyst, it is advantageous to maintain a certain concentration of hydrogen sulfide in the recycled gases so that, for example, the ratio by volume of $H_2S$ to $H_2$ be from 200 to 4000 ppm in reactor 9.

The following steps of the process are performed as explained with reference to FIG. 1. The charge made free from unsaturated hydrocarbons in zones 3 and 9, is introduced through line 11 successively in several aromizing reactors (two reactors 12 and 13 have been shown in FIG. 2 instead of four reactors in FIG. 1). The resulting product withdrawn through duct 14, passes through flash 15 in view to remove the gaseous fraction, this fraction being in part hydrogen which will be made sufficiently pure by mere passing through a cooler 16. The recycled purified hydrogen is sent through duct 17 to the aromizing reactors and through duct 18 to the hydrodealkylation reactor 28. The duct through which is supplied fresh hydrogen necessary for starting the aromizing reaction in reactors 12 and 13, is not shown in FIG. 2. The product withdrawn from the flash through line 19 is sent to a fractionation zone 20 (operated at a pressure substantially identical or lower than the pressure prevailing in each aromizing reactor) from where we withdraw, for example, heavy products in column 22, light products through duct 21, a benzene fraction through duct 27, toluene through duct 23, which is fed to the hydrodealkylation zone, and xylenes withdrawn separately through duct 25 or withdrawn through duct 24 and fed with the toluene fraction through duct 26 to the hydrodealkylation zone 28.

The product obtained in zone 28 is withdrawn through duct 29 and sent to a fractionation zone 30 from where light products are withdrawn at the top through duct 31, and the fraction withdrawn from the bottom of the column is recycled to the hydrodealkylation reactor through duct 33; the final product is withdrawn through duct 32.

The following examples illustrate the invention.

EXAMPLE 1

This example is illustrated by FIG. 1

The starting material, or charge, consists of a straight run gasoline cut whose main features are as follows:

| | |
|---|---|
| - molecular weight: 92.2 | |
| - specific gravity at 20° C : 0.702 | |
| - ASTM distillation: | initial point : 73° C<br>final point : 99° C |

| Composition by weight: | |
|---|---|
| - isopentane + n.pentane | 1.59 % |
| - isohexanes + n.hexane | 24.22 % |
| - isoheptanes + n.heptane | 42.55 % |
| - cyclopentane | 0.13 % |
| - methyl cyclopentane | 6.72 % |
| - cyclohexane | 5.50 % |
| - $\Sigma$ $C_7$ naphthenes | 15.81 % |
| - $\Sigma$ $C_8$ naphthenes | 0.14 % |

-continued

| | |
|---|---|
| - benzene | 1.68 % |
| - toluene | 1.66 % |
| | 100 % |

This charge is sent to the aromizing section, comprising 4 fixed bed reactors in series, identical in volume, where each reactor is operated as follows:

pressure: 10 bars
temperature: 540° C (except in the fourth reactor where the temperature was 570° C)
hourly flow rate of the liquid charge: 3 times the catalyst volume
molar ratio $H_2$/charge: 6

The catalyst has the following composition by weight:

0.6% of platinum
0.04% of iridium
0.04 % of silver
1.2% of chlorine.

The carrier is alumina in balls whose specific surface is 250 $m^2/g$ and the pore volume 0.6 cc per gram.

The final catalyst has a specific surface of 245 $m^2/g$, a pore volume of 0.57 cc/g and a neutralization heat by ammonia adsorption of 27 calories per gram at 320° C under a pressure of 300 Torr.

When starting the reaction, the hydrogen is fresh hydrogen but, thereafter, the hydrogen will be exclusively recycled hydrogen introduced through duct 3.

The product issued from reactor 7 has the following composition b.w., hydrogen being excepted:

| | |
|---|---|
| - $C_1$ | 6.20 % |
| - $C_2$ | 7.80 % |
| - $C_3$ | 8.10 % |
| - $C_4$ | 11.15 % |
| - $C_5$ | 7.85 % |
| - $C_6$ | 2.26 % |
| - $C_7$ | 0.11 % |
| - cyclopentane | 0.09 % |
| - methylcyclopentane | 0.12 % |
| - benzene | 22.13 % |
| - toluene | 33.14 % |
| - $C_8$ aromatics | 0.62 % |
| - $C_9$+ aromatics | 0.43 % |
| | 100.00 % |

The hydrocarbon constituents form 96.85% b.w. of the introduced charge, the remaining 3.15% representing the hydrogen produced by the reaction, which corresponds to a conversion rate of 99.76% by weight for naphthenes and 96.58 % for $C_6$ and $C_7$ paraffins.

The total selectivities by weight are respectively 64.5% for the aromatic hydrocarbons and 35.5% for cracking.

The gas products from duct 12 obtained after separation of the gas and liquid phases under 10 bars and at 5° C and passage through the cooler 11 whose temperature is 5° C, have the following composition by volume:

| | |
|---|---|
| - hydrogene | 73 % |
| - $C_1$ | 13.28 % |
| - $C_2$ | 7.82 % |
| - $C_3$ | 4.05 % |
| - $C_4$ | 1.65 % |
| - $C_5$ | 0.18 % |

After separation by stripping of the normally gaseous constituents (mainly cracking products) the product is fractionated in zone 15 operated at about the same pressure (10 bars) as in the aromizing reactors. There is thus obtained a top cut, containing non aromatic hydrocarbons ($C_3$ to $C_6$) whose composition is given below, and various cuts at different levels of the fractionation zone. The composition by weight of the obtained hydrocarbons is given hereinunder:

| | % by weight |
|---|---|
| - benzene | 40.10 |
| - toluene | 58.84 |
| - $C_8$+ aromatics | 0.24 |
| - $C_6$ paraffins | 0.08 |
| - $C_7$ paraffins | 0.74 |
| | 100.00 |

The yield of $C_7$+ is 60.84% by weight. The "light" $C_6$− fraction has the following composition by weight:

| | |
|---|---|
| - $C_1$ | 12.13 |
| - $C_2$ | 16.88 |
| - $C_3$ | 18.18 |
| - $C_4$ | 22.17 |
| - $C_5$ | 17.75 |
| - $C_6$ | 12.13 |
| - $C_7$ | 0.13 |
| - $C_5$ and $C_6$ naphthenes | 0.63 |
| | 100.00 |

The benzene cut withdrawn through line 18 amounts to 21.50% by weight of the initial charge subjected to aromizing. Said benzene has the following characteristics:

crystallization point: 5.43° C
non aromatics: 0.076% b.w.
toluene: 68 ppm
total sulfur: 1 ppm.

The fractions (recovered separately or jointly) containing toluene (duct 20), $C_8$ aromatics (duct 21) and $C_9$ aromatics (duct 22) are joined to form a cut having the following composition by weight:

| | |
|---|---|
| - benzene | 0.30 % |
| - toluene | 97 % |
| - $C_8$ aromatics | 1.80 % |
| - $C_9$ aromatics | 0.90 % |

This cut is fed to the hydrodealkylation reactor 24.

It is obvious that in the case where the recovering of xylenes is interesting on an economical point of view, they can be obtained directly from duct 30. This case will be explained more in detail in example 2 concerning the treatment of a steam-cracking cut.

The aromatic cut subjected to hydrodealkylation is sent to a reactor 24 containing a hydrodealkylation catalyst.

The catalyst contains 15% of cobalt and 3% of zinc. The catalyst has a specific surface of 9.5 $m^2/g$, a pore volume of 0.7 cc/g and a neutralization heat of 3.5 calories per gram in the above-mentioned conditions.

The operating conditions are as follows:

temperature: 550° C
pressure: 10 bars
VVH: 4 volumes of liquid charge per volume of catalyst and per hour
relative hydrogen flow rate: 5.7 moles per mole of hydrogen.

The hydrogen required for this operation is that previously produced during the aromizing step.

As a matter of fact, the recycled gases have a hydrogen content of about 73% by volume; thus the hydrogen is sufficiently pure for being used in the hydrodealkylation step; on the other hand, the hydrogen produced in the aromizing step amounts to 1.57 mole per 100 g of charge; and for the same charge amount, there is obtained 32.23 g of toluene, i.e. 0.35 mole of toluene.

This toluene, for being converted to benzene and methane, will theoretically consume 0.35 mole of hydrogen. As it may be observed, the amount of available hydrogen is amply sufficient (about 5 times more than the required amount). After reaction, the product is stabilized by separating the normally gaseous products (hydrogen, methane, ethane, etc . . . )

The product before stabilization had the following composition by weight:

| | |
|---|---|
| - $C_1$ | 12.50 |
| - $C_2$ | 0.20 |
| - $C_3$ | 0.20 |
| - benzene | 45.60 |
| - toluene | 41.49 |
| - $C_8$+ | <0.10 |

After stabilization, the composition by weight of the product is as follows:

| | |
|---|---|
| - benzene | 52.40 |
| - toluene | 47.60 |
| - $C_8$+ | <0.10 |

In this hydrodealkylation step, the conversion of toluene and $C_8$+ is 58.2%.

The molar yield of benzene is 53.8%

Cracking amounts to 7.5%

The benzene selectivity is 92.5%.

EXAMPLE 2

This example is illustrated in FIG. 2.

The charge consists of a steam-cracking gasoline having the following composition by weight:

| | |
|---|---|
| - paraffins | 4.2 % |
| - monoolefins | 7.8 % |
| - aromatics | 56.8 % |
| - naphthenes | 12.3 % |
| - diolefins | 8 % |
| - cycloolefins | 4.1 % |
| - alkenylaromatics | 6.8 % |

Its main characteristics are as follows:

| | |
|---|---|
| - specific gravity at 15° C | 0.811 |
| - ASTM distillation | |
| . initial point | 37° C |
| . final point | 186° C |
| - bromine number | 59 |
| - maleic anhydride number | 87 |
| - potential gums | 9,400 mg/100 cc |
| - induction period | 85 minutes |
| - total sulfur | 430 ppm by weight. |

This gasoline is passed through unit 3 where it is selectively hydrogenated, in the presence of a catalyst containing 10% of nickel deposited on alumina, the operating conditions being as follows:

| | |
|---|---|
| - temperature | 140° C |
| - absolute pressure | 28 kg/cm² |
| - hourly flow rate by volume | 2 volumes per volume of catalyst |
| - hydrogen partial pressure | 12 kg/cm² |
| - molar ratio hydrogen/hydrocarbon | 0.5 at the inlet of the reactor. |

The product issued from the reactor is fractionated in device 5 into the following cuts:

a light cut (mainly $C_5$) removed at the top of the column through line 6; its maleic anhydride value is lower than 15; It may accordingly be admixed with gasoline and upgraded as a carbureting composition or in other petrochemical uses.

a $C_9$+ cut recovered at the column bottom (through duct 7): its maleic anhydride value is lower than 5; it may be upgraded as a carbureting as carburating composition of may be used in other petrochemical applications, but it may also, if not recovered at the column bottom, be subjected to a joint treatment with the $C_6$–$C_8$ cut.

the intermediate $C_6$–$C_8$ cut had the following composition by weight:

| | |
|---|---|
| - monoolefines | 4.6 % |
| - benzene | 53.4 % |
| - toluene | 18.7 % |
| - xylenes | 2.75 % |
| - ethylbenzene | 0.75 % |
| - paraffins | 4.4 % |
| - naphthenes | 15.4 % |

Its main characteristics were the following:

| | |
|---|---|
| - bromine number | 8 |
| - maleic anhydride value | 1 |
| - ASTM distillation | |
| . initial point | 54° C |
| . final point | 149° C |
| - potential gums | naught |
| - total sulfur | 380 ppm b.w. |

This intermediate cut is used with hydrogen to feed, through line 8, reactor 9 of a second unit; this reactor contains two beds of a catalyst containing 2.5% b.w. of cobalt oxide and 12% of molybdenum oxide deposited on alumina having a specific surface of 50 m²/g as an average. The first bed represents one-fourth of the total catalyst volume and the second bed three-fourths of said volume.

The operating conditions were the following:

| | |
|---|---|
| - temperature : | 340° C |
| - total pressure : | 40 kg/cm² |
| - hourly flow rate of the charge by volume : | 4 volumes per volume of catalyst |
| - hydrogen partial pressure : | 18 kg/cm². |

After evolution of the normaly gaseous constituents, i.e. hydrogen and impurities contained therein (methane, ethane, propane), and of hydrogen sulfide, the final product P discharged from the reactor had the following composition by weight:

| | |
|---|---|
| - monoolefines | 0 % |
| - benzene | 52.9 % |
| - toluene | 18.2 % |
| - xylenes | 2.65 % |
| - ethylbenzene | 0.65 % |
| - paraffins | 9 % |
| - naphthenes | 16.6 % |

Its main characteristics were as follows:

| | |
|---|---|
| - bromine number | <0.2 |
| - maleic anhydride number | null |
| - potential gums | null |
| - ASTM distillation | |
| . initial point | 52° C |
| . final point | 151° C |
| - total sulfur | 2 ppm by weight |

The detailed composition by weight of said product P was as follows:

| | | |
|---|---|---|
| Paraffins | | |
| - $C_5$ | traces | 9 % |
| - $C_6$ | 0.40 | |
| - $C_7$ | 3.90 | |
| - $C_8$ | 4.70 | |
| Naphthenes | | |
| - $C_5$ | traces | 16.6 % |
| - $C_6$ | 9 | |
| - $C_7$ | 6 | |
| - $C_8$ | 1.6 | |
| Aromatics | | |
| - benzene | 52.9 | 74.4 % |
| - toluene | 18.2 | |
| - meta + para xylenes | 2.2 | |
| - ortho xylene | 0.45 | |
| - ethylbenzene | 0.65 | |

This charge is conveyed to the aromizing section (fixed bed reactors 12 and 13, of identical volumes), whose operating conditions are as follows:

pressure: 10 bars temperature: 540° C in the first reactor and 570° C in the second reactor hourly flow rate of the liquid charge: 3 times the catalyst volume molar ratio $H_2$/charge: 6

We use a catalyst whose composition by weight is as follows:

0.6% platinum 0.04% iridium 0.04% gold 1.2% chlorine.

The carrier consist of alumina balls of a 250 $m^2/g$ specific surface and whose pore volume is 0.6 cc per gram. The final catalyst has a specific surface of 245 $m^2/g$, a pore volume of 0.57 cc/g and a neutralization heat by ammonia adsorption of 27 calories per gram at 320° C under a pressure of 300 Torr.

The product discharged from the second reactor 13, through duct 14, has the following composition by weight, hydrogen being excepted:

| | |
|---|---|
| - $C_1$ paraffins | 1.65 % |
| - $C_2$ paraffins | 1.85 % |
| - $C_3$ paraffins | 1.95 % |
| - $C_4$ paraffins | 2.55 % |
| - $C_5$ paraffins | 2.39 % |
| - cyclopentane | 0.14 % |
| - benzene | 69.9 % |
| - toluene | 21.00 % |
| - xylene | 2.47 % |
| - ethyl benzene | 0.50 % |

The hydrocarbon products form 99.43% b.w. of the charge introduced into reactor 12, the difference to 100% i.e. 0.57% (b.w.) being the hydrogen produced during the reaction; the conversion rate is thus 99.15% for naphthenes and 100% for paraffins. The overall selectivities are respectively by weight, 66.6% for the aromatic hydrocarbons and 33.4% for cracking.

In flash vaporizer 15, the gaseous cracking products, having the following composition by weight (hydrogen being expected) are separated:

| | |
|---|---|
| - methane | 34 % |
| - $C_2$ | 33 % |
| - $C_3$ | 21 % |
| - $C_4$ | 9.9 % |
| - $C_5$ | 2.1 % |

The hydrogen present in these gaseous products has a purity of 80% after passing through a cooler 16 operated at 6° C. A portion is fed back to the aromizing reactors through duct 17, another portion is introduced through duct 18, into the hydrodealkylation reactor 28.

The product withdrawn from duct 19 is fractionated in zone 20; the top fraction is a $C_3$ to $C_6$ cut of non aromatic hydrocarbons having the following composition by weight:

| | |
|---|---|
| - $C_1$ | 0.1 % |
| - $C_2$ | 3.3 % |
| - $C_3$ | 16.6 % |
| - $C_4$ | 33.6 % |
| - $C_5$ | 35.0 % |
| - $C_6$ | 10.0 % |

There is also obtained a cut consisting exclusively of benzene having the following characteristics:

| | |
|---|---|
| - crystallization point | : 5.44° C |
| - non aromatics | : 0.074 % b.w. |
| - toluene | : 65 ppm b.w. |
| - total sulfur | : <1 ppm b.w. |

This benzene as such is recovered as final product.

There is also obtained a xylenes cut (from duct 25) having as impurities:

| | |
|---|---|
| - toluene | 800 ppm b.w. |
| - non aromatics | 300 ppm b.w. |
| - total sulfur | < 2 ppm b.w. |

In the present example, xylenes which correspond to the specifications (99.6% of purity) are separated and recovered as final product.

There is also obtained a toluene cut, which is sent through ducts 23 and 26 to the hydrodealkylation zone 28.

The charge at the inlet of the hydrodealkylation zone had the following composition by weight:

| | |
|---|---|
| - benzene | 0.3 % |
| - toluene | 99.1 % |
| - $C_8$ aromatics | 0.3 % |
| - paraffins | 0.3 % |

This charge is subjected to the same operating conditions as those described in example 1 in the presence of a catalyst containing 15% of cobalt and 3.5% of cadmium. This catalyst has a specific surface of 9.5 $m^2/g$, a pore volume of 0.7 cc/g and a neutralization heat of 3.5 calories/g in the above-mentioned conditions.

Although, in the case of the second example, the amount of hydrogen produced during the aromizing step is less than in example 1, i.e. 0.28 mole of hydrogen per 100 g of charge (1.57 moles in example 1), this amount is nevertheless largely sufficient since in the present case, only 0.23 mole of toluene per 100 grams of charge is to be hydrodealkylated.

The resulting product, after reaction, had the following composition (hydrogen being excepted):

| | |
|---|---|
| - methane | 11.80 % |
| - $C_2$ | 0.10 % |
| - $C_3$ | 0.10 % |
| - benzene | 46.40 % |
| - toluene | 41.60 % |

The composition by weight of the resulting product, after elimination of the normally gaseous products, is as follows:

| | |
|---|---|
| - benzene | 52.70 % |
| - toluene | 47.30 % |
| - $C_8$+ | <0.10 |

The toluene conversion amounts to 58.1%
The molar yield of benzene is 54.8%
Cracking amounts to 5.8%
and the selectivity to benzene is 94.2%

What we claim is:

1. A process for producing aromatic hydrocarbons from unsaturated or saturated gasolines, in which these gasolines, after removal of deleterious quantities of diolefins or olefins contained therein, if any, are passed through at least two aromizing reaction zones, arranged in series, in the presence of hydrogen, said hydrogen, except when starting the reaction, being essentially recycled hydrogen, as defined below, and in the presence of a catalyst containing a) alumina, b) 0.1 to 10% of at least one halogen, expressed by weight with respect to the alumina, and c) at least two metals or metal compounds, at least one of which is selected from the noble metals from the platinum family, the concentration of said metal being from 0.01 to 5% b.w. with respect to the alumina, at a temperature of about 400° to 600° C, the temperature of at least the last reaction zone through which the charge is passed being from 480° to 600° C, under a pressure substantially identical in each of the aromizing zones, said pressure being about 10 kg/cm², with an hourly flow rate by volume of the liquid charge from about 0.1 to 10 times the catalyst volume, the molar ratio hydrogen/hydrocarbon being about 0.5 to 20, in which process the effluent from the last reaction zone through which the charge is passed, is so treated as to remove therefrom a normally gaseous vapor fraction which is subjected to cooling at a temperature from −15 to +15° C, so as to recover a hydrogen stream called "recycled hydrogen" whose purity is higher than 70% by volume, at least a portion of said recycled hydrogen being fed to at least one of the aromizing reaction zones, in which process said effluent, after removal of the vapor fraction is subjected to fractionation at a pressure substantially equal to or lower than that prevailing in the aromizing reaction zones, so as to recover at least one aromatic cut as final product and at least one cut consisting essentially of at least one alkyl aromatic hydrocarbon, the latter cut being fed to at least one hydrodealkylation zone where said cut is treated in the presence of hydrogen, said hydrogen being exclusively at least a portion of the recycled hydrogen, in the presence of a catalyst which includes alumina 0.05 to 20% of cobalt by weight of the catalyst and 0.2 to 20% by weight of the catalyst of a metal selected in the group consisting of zinc, cadmium, gallium, indium, germanium, manganese, copper, silver, gold, niobium and zirconium, the catalyst having a specific surface from about 1 to 100 m²/g, a pore volume from about 0.2 to 1.0 cc/g and a neutralization heat by ammonia adsorption lower than 10 calories per gram of catalyst at 320° C under 300 mm Hg, the hydrodealkylation step being conducted at a temperature from 500° to 620° C, the spatial velocity being from 1 to 10, the ratio hydrogen/hydrocarbon expressed in mole by mole being from 1 to 10, the pressure being about 10 kg/cm².

2. A process according to claim 1, in which the temperature in at least the last aromizing zone, through which the charge is passed, is from 500° to 585° C.

3. A process according to claim 2, in which the temperature is from 540° to 580° C.

4. A process according to claim 2, in which the effluent from the last aromizing reaction zone is so treated as to remove therefrom a vapor fraction which is subjected to cooling at a temperature from −10 to +10° C.

5. A process according to claim 4, in which the cooling temperature is from −4 to +8° C.

6. A process according to claim 4, in which the catalyst used in the one or more hydrodealkylation zones has a specific surface from 5 to 80 m²/g and a pore volume from 0.3 to 0.8 cc/g.

7. A process according to claim 6, in which the catalyst used in the one or more hydrodealkylation zones, has a neutralization heat by ammonia adsorption lower than 7 calories per gram of catalyst at 320° C under a pressure of 300 mm Hg.

8. A process according to claim 7, in which the catalyst used in the one or more hydrodealkylation zones contains by weight in proportion to the catalyst, 1 to 17% of cobalt and 0.8 to 17% of an additional metal selected from zinc, cadmium, gallium, indium, germanium, manganese, copper, silver, gold, niobium and zirconium.

9. A process according to claim 1, in which the temperature in at least the last aromizing zone, through which the charge is passed, is from 540° to 580° C and higher than the temperature prevailing in the one or more aromizing reaction zones.

10. A process according to claim 8, wherein the aromizing catalyst contains (a) alumina, (b) 0.1 to 10% by weight with respect to alumina of at least one halogen, (c) 0.005 to 2% of platinum by weight with respect to alumina, (d) 0.02 to 0.1% by weight with respect to alumina, of a metal selected from iridium and rhodium and (e) 0.02 to 0.1% by weight with respect to the alumina, of a metal selected from copper, silver, gold and manganese.

* * * * *